US010513122B2

(12) United States Patent
Wagner et al.

(10) Patent No.: US 10,513,122 B2
(45) Date of Patent: Dec. 24, 2019

(54) METHODS AND APPARATUS TO REDUCE INK EVAPORATION IN PRINTHEAD NOZZLES

(71) Applicant: Hewlett-Packard Development Company, L.P., Houston, TX (US)

(72) Inventors: Jeffrey Allen Wagner, Vancouver, WA (US); Maria Magdalena Martinez Ferrandiz, Barcelona (ES); Ronald Albert Askeland, San Diego, CA (US); Marian Dinares Argemi, Terrassa (ES); Chandrasekhar Nadimpalli, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/039,201

(22) Filed: Jul. 18, 2018

(65) Prior Publication Data

US 2018/0319168 A1 Nov. 8, 2018

Related U.S. Application Data

(63) Continuation of application No. 15/500,819, filed as application No. PCT/US2014/049229 on Jul. 31, 2014, now Pat. No. 10,040,291.

(51) Int. Cl.

| | |
|---|---|
| ***B41J 2/175*** | (2006.01) |
| ***B41J 2/005*** | (2006.01) |
| ***B41J 2/165*** | (2006.01) |
| ***B41J 2/04*** | (2006.01) |
| ***B41J 2/14*** | (2006.01) |

(52) U.S. Cl.
CPC ..... *B41J 2/175* (2013.01); *B41J 2/005* (2013.01); *B41J 2/04* (2013.01); *B41J 2/14* (2013.01); *B41J 2/14201* (2013.01); *B41J 2/165* (2013.01)

(58) Field of Classification Search
CPC ..... B41J 2/005; B41J 2/04; B41J 2/14; B41J 2/14016; B41J 2/14201; B41J 2/175; B41J 2/1753; B41J 2/165; B41J 2202/05
See application file for complete search history.

(56) References Cited

U.S. PATENT DOCUMENTS

| | | | |
|---|---|---|---|
| 5,992,964 | A | 11/1999 | Yamaguchi |
| 6,102,518 | A | 8/2000 | Taylor |

(Continued)

FOREIGN PATENT DOCUMENTS

| | | |
|---|---|---|
| JP | 08300684 | 11/1996 |
| WO | WO-02096652 | 12/2002 |
| WO | WO-2014/046658 | 3/2014 |

OTHER PUBLICATIONS

Almeida et al., "Nonvolatile Liquid-Film-Embedded Microfluidic Valve for Microscopic Evaporation Control . . . ," IEEE Jnl of Microelectromechanical Systems, Aug. 2012.

*Primary Examiner* — Anh T Vo
(74) *Attorney, Agent, or Firm* — HP Inc. Patent Department

(57) ABSTRACT

Methods and apparatus control the ejection of fluid from a nozzle by selectively actuating a fluid actuator that displaces and ejects fluid through an ejection orifice of the nozzle. The methods and apparatus at least partially closing the ejection orifice of the nozzle, while the fluid actuator is inactive, to reduce evaporation of the fluid.

20 Claims, 13 Drawing Sheets

(56) References Cited

U.S. PATENT DOCUMENTS

| | | | | |
|---|---|---|---|---|
| 6,390,585 | B1 | 5/2002 | Schiaffino et al. | |
| 6,481,824 | B1 | 11/2002 | Hayakawa | |
| 6,578,947 | B1 | 6/2003 | Suwabe et al. | |
| 6,585,343 | B2 | 7/2003 | Bauer | |
| 6,634,731 | B2 | 10/2003 | Kao et al. | |
| 6,767,076 | B2 | 7/2004 | Silverbrook et al. | |
| 7,029,091 | B2 | 4/2006 | Stellbrink et al. | |
| 7,163,272 | B2 | 1/2007 | Parish et al. | |
| 7,341,324 | B2 | 3/2008 | Juve et al. | |
| 7,384,115 | B2 | 6/2008 | Barkley | |
| 7,753,484 | B2 | 7/2010 | Silverbrook et al. | |
| 7,762,647 | B2 | 7/2010 | Mehta | |
| 7,926,898 | B2 | 4/2011 | Snyder et al. | |
| 7,986,439 | B2 | 7/2011 | Walmsley | |
| 8,033,631 | B2 | 10/2011 | Kanno | |
| 8,500,231 | B2 | 8/2013 | Nishihara | |
| 8,556,398 | B2 | 10/2013 | Gunnell et al. | |
| 8,579,410 | B1 | 11/2013 | Simmons | |
| 8,664,297 | B2 | 3/2014 | Fujii | |
| 2002/0033856 | A1 | 3/2002 | Moon | |
| 2007/0291066 | A1 | 12/2007 | Takabayashi et al. | |
| 2009/0147042 | A1 | 6/2009 | McAvoy et al. | |
| 2009/0147044 | A1 | 6/2009 | McAvoy et al. | |
| 2010/0143581 | A1 | 6/2010 | Eldershaw | |
| 2015/0183227 | A1* | 7/2015 | Ishikawa | B41J 2/175 347/89 |

* cited by examiner

METHODS AND APPARATUS TO REDUCE INK EVAPORATION IN PRINTHEAD NOZZLES

CROSS-REFERENCE TO RELATED APPLICATIONS

The present application is a continuation application claiming priority under 35 USC § 120 from co-pending U.S. patent application Ser. No. 15/500,819 filed on Jan. 31, 2017 by Wagner et al. and entitled METHODS AND APPARATUS TO REDUCE INK EVAPORATION IN PRINTHEAD NOZZLES which was a 371 patent application claiming priority under 35 USC § 119 from PCT/US2014/049229 filed in Jul. 31, 2014 by Wagner et al. and entitled METHODS AND APPARATUS TO REDUCE INK EVAPORATION IN PRINTHEAD NOZZLES, the full disclosures both of which are hereby incorporated by reference.

BACKGROUND

Inkjet printing devices include a printhead having a number of nozzles. The nozzles are used to eject fluid (e.g., ink) onto a substrate to form an image. Some inkjet printing devices include a stationary printbar that includes one or more printheads. Such printing devices are known as wide array printers (e.g., page wide array printers). The printbar of a wide array printer spans the width of a printable area of the printer such that the printbar may remain stationary during printing. A substrate to be printed is moved past the stationary printbar of the wide array printer.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
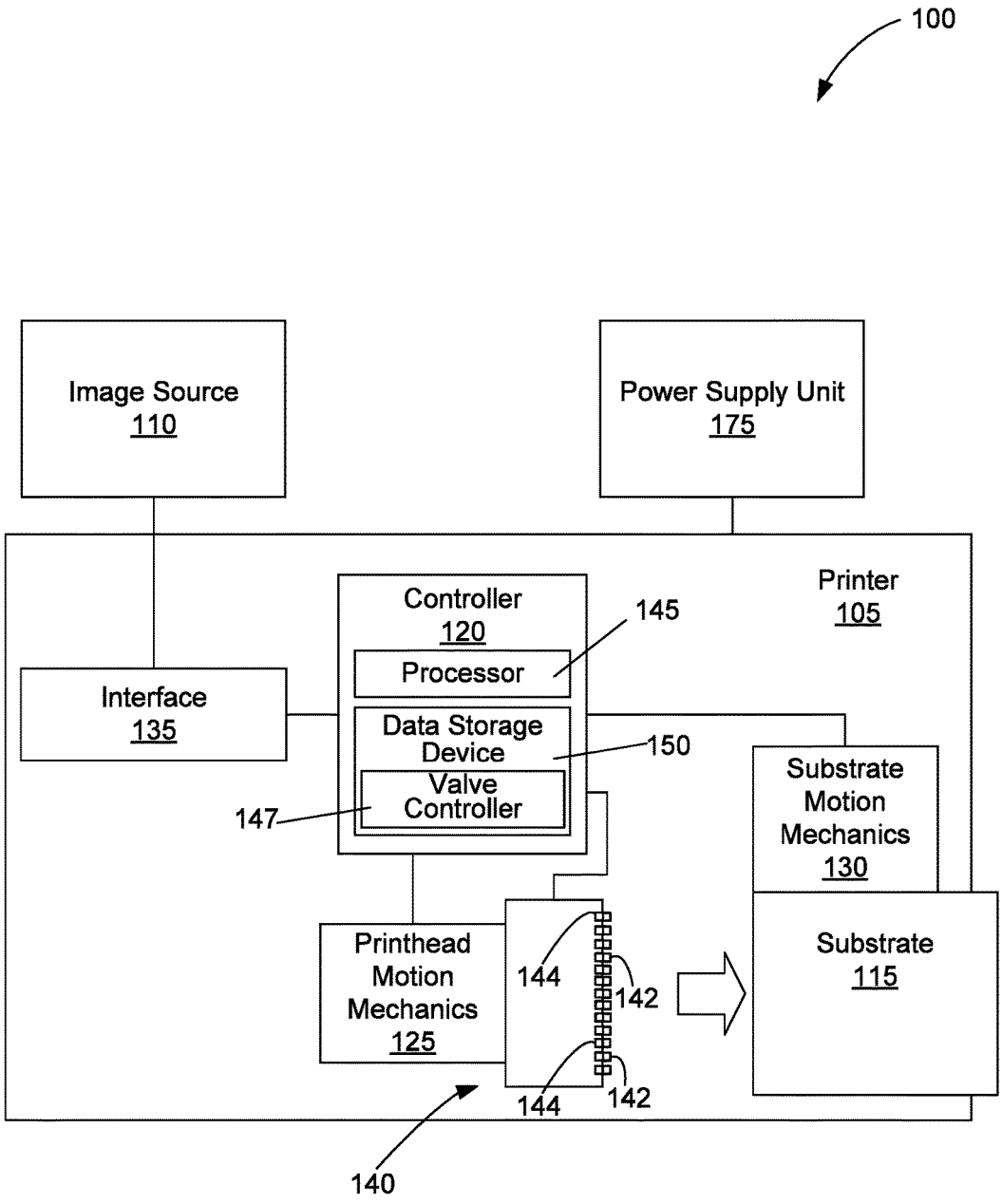
FIG. 1 is a schematic illustration of an example printing apparatus that can be used to implement the examples disclosed herein.

In a wide array printing apparatus or other printing apparatus including a printbar, the size of a substrate being imaged may be smaller than a size of the printbar. When the substrate is smaller than the printbar, some nozzles (or printheads) overlying the substrate may be used to image the substrate and some nozzles (or printheads) that are spaced away from the substrate may not be used to image the substrate. In another example, a section of the substrate may be left blank during the printing (e.g., a margin or other area where no printing is to occur based on the image to be printed). When a section of the substrate is left blank, some nozzles (or printheads) overlying the image may be used to image the substrate and some nozzles (or printheads) overlying the blank section of the substrate may not be used to image the substrate.

If a nozzle of a printhead is not being used, ink within the nozzle may come into contact with air and start to evaporate, dry up and/or separate. When ink evaporates within a nozzle there may be a loss of ink and/or print quality may be impacted by dried ink in the nozzle. Some existing printers include a cap for the entire printhead to reduce ink evaporation in the nozzles of the capped printhead. However, capping an entire printhead while printing would prevent any printing by the capped printhead.

Examples disclosed herein reduce ink evaporation and maintain operability of inkjet devices by selectively capping individual nozzles of a printhead. Thus, while imaging a substrate, some nozzles of a printhead may be capped and not used and other nozzles may be used and not capped. In some examples, the respective nozzles are capped using valves positioned within and/or adjacent respective nozzles. In some examples, the valves are controllable (e.g., actuatable) between a closed position that substantially prevents ambient air from accessing a nozzle opening and/or ink within the nozzle and an open position that enables ambient air to access the nozzle opening and/or the ink within the nozzle. As used herein, substantially preventing air from accessing ink within the nozzle is defined as causing air flow to the nozzle to be minimized, reduced, and/or blocked by the valve being in a closed position as compared to when the valve is in an open position.

In some examples, the valve(s) is a microfluidic valve such as a shutter valve and/or a sliding valve. In examples in which the valve is implemented as a sliding valve, a piezoelectric actuator may actuate a gate (e.g., a plug) between a closed position and an open position. The piezos may be positioned on one or both sides of the gate to move the gate back and forth. In some examples, in the open position, an aperture through the gate aligns with the aperture of the nozzle to enable fluid flow through the nozzle. In some examples, in the open position, the gate is spaced from the aperture of the nozzle to enable fluid flow through the nozzle.

In other examples, the valve includes electrodes on the sides of a nozzle aperture to manipulate a dielectric fluid (e.g., a dielectric drop) between a covering position and a non-covering position. In the covering position (e.g., closed position), voltage is provided to electrodes on either side of the aperture to move and hold the dielectric fluid over the aperture. In the non-covering position (e.g., open position), voltage is provided to electrodes on one side of the aperture to move and hold the dielectric fluid away from the aperture and adjacent the energized electrodes on the side of the aperture.

In some examples, the print area is determined by the dimensions of the substrate. In another example, the print area is determined by the dimensions of the image to be printed on the substrate. In some examples, the print area is determined by both of the dimensions of the substrate and the dimensions of the image to be printed on the substrate.

FIG. 1 is a block diagram of an example printing apparatus 100 that can be used to implement the teachings of this disclosure. The example printing apparatus 100 of FIG. 1 includes a printer 105, an image source 110 and a substrate (e.g., paper) 115. The image source 110 may be a computing device from which the printer 105 receives data describing a print job to be executed by a controller 120 of the printer 105 to print an image on the substrate 115.

In the example of FIG. 1, the printing apparatus 100 also includes printhead motion mechanics 125 and substrate motion mechanics 130. In some examples, the printhead and substrate motion mechanics 125, 130 include mechanical devices that move a printhead 140 and/or the substrate 115, respectively, when printing an image on the substrate 115. In some examples, instructions to move the printhead 140 and/or the substrate 115 may be received and processed by the controller 120 (e.g., from the image source 110). In some examples, signals may be sent to the printhead 140 and/or the substrate motion mechanics 130 from the controller 120. In examples when the printing apparatus 100 is implemented as a page-wide array printer, the printhead 140 may be stationary and, thus, the printing apparatus 100 may not include the substrate motion mechanics 130 or the substrate motion mechanics 130 may not be utilized.

The example printer 105 of FIG. 1 includes an interface 135 to interface with the image source 110. The interface 135 may be a wired or wireless connection connecting the printer 105 and the image source 110. The image source 110 may be a computing device from which the printer 105 receives data describing a print job to be executed by the controller 120. In some examples, the interface 135 enables the printer 105 and/or a processor 145 to interface with various hardware elements, such as the image source 110 and/or hardware elements that are external and/or internal to the printer 105. In some examples, the interface 135 interfaces with an input or output device such as, for example, a display device, a mouse, a keyboard, etc. The interface 135 may also provide access to other external devices such as an external storage device, network devices such as, for example, servers, switches, routers, client devices, other types of computing devices and/or combinations thereof.

In the illustrated example, the printer 105 includes the example printhead 140 having a plurality of nozzles 142. The plurality of nozzles 142 are provided with a plurality of valves 144. The valves 144 may be similar or different from one another. In some examples, to substantially prevent ink within respective nozzles 142 from evaporating and/or to substantially prevent ambient air from flowing into the respective nozzles 142, an example valve controller 147 stored in a data storage device 150 and executed by the processor 145 may control the valve(s) 144 between an open position and a closed position. In some examples, the valve controller 155 causes some valves 144 to be in the closed position when those respective valves 144 are not being used during a printing operation and causes other valves 144 to be in the open position when those respective ones of the valves144 are associated with ones of the nozzles 142 that are being used during the printing operation. In some examples, the nozzles 142 that are not being used during a printing operation are outside of a printing area and are at a distance from a perimeter edge of a substrate to be imaged and/or at a distance from a perimeter edge of an image to be printed.

The example controller 120 includes the example processor 145, including hardware architecture, to retrieve and execute executable code from the example data storage device 150 which contains the example valve controller 147. The executable code may, when executed by the example processor 145, cause the processor 145 to implement at least the functionality of printing on the example substrate 115, actuating the printhead and/or substrate motion mechanics 125, 130 and controlling the valves 144. The executable code may, when executed by the example processor 145, cause the processor 145 to provide instructions to a power supply unit 175, to cause the power supply unit 175 to provide power to the printhead 140 to eject a fluid from the nozzle(s) 142 and/or to control, actuate and/or deactivate the valve(s) 144.

The data storage device 150 of FIG. 1 stores data, such as executable program code including the valve controller 147 instructions, that is executed by the example processor 145 or other processing devices. The example data storage device 150 may store computer code representing a number of applications, including the example valve controller 147, that the example processor 145 executes to implement the examples disclosed herein. The example valve controller 147 determines a print area based on substrate and image dimensions, identifies a subset of the nozzles 142 that are located within the print area, and controls the example valves 144 to selectively open the valves 144 that are inside the print area while closing ones of the example valves 144 of the nozzles 142 that are outside the print area.

Figure 2:
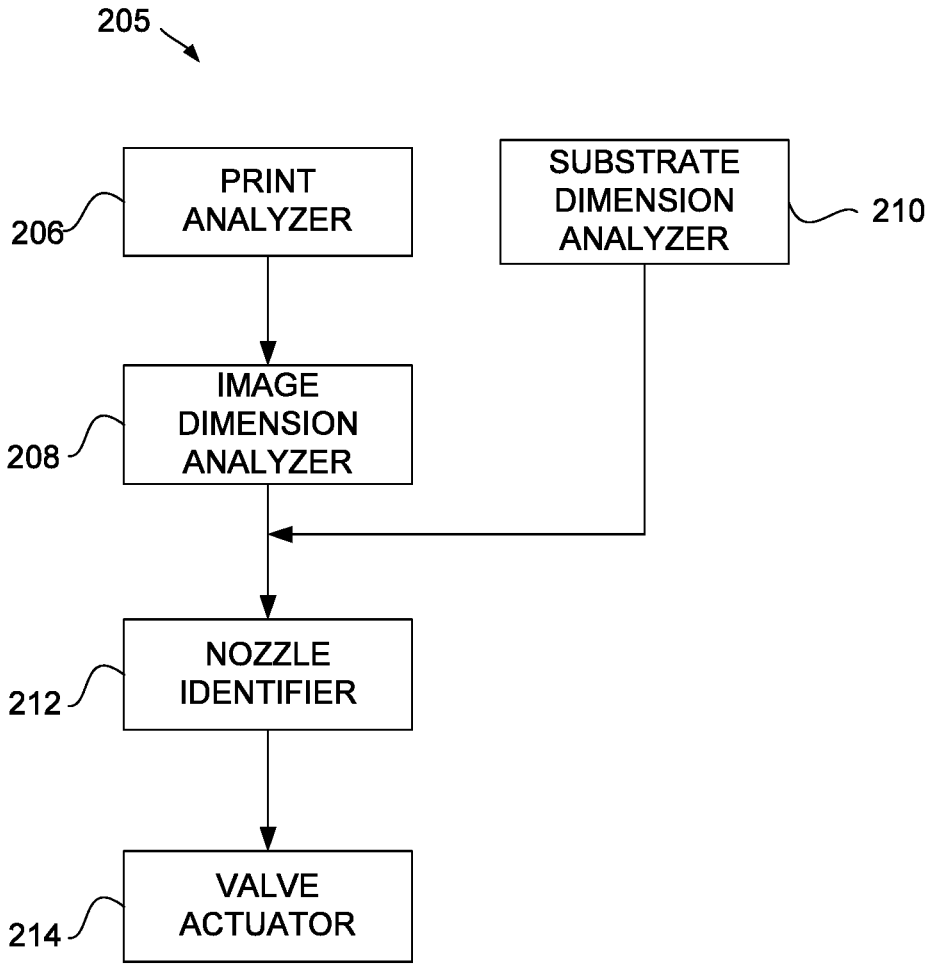
FIG. 2 is a block diagram of an example implementation of a valve controller that can be used to implement the example printing apparatus of FIG. 1.

FIG. 2 is a block diagram of an implementation of an example valve controller 205. The example valve controller 205 of FIG. 2 may be used to implement the example valve controller 147 of FIG. 1. The valve controller 205 of the illustrated example includes an example print analyzer 206, an example image dimension analyzer 208, an example substrate dimension analyzer 210, an example nozzle identifier 212, and an example valve actuator 214.

The example print analyzer 206 receives information about requested print jobs from the image source 110. A print job may be comprised of print commands and print data associated with the print job that may be used by the example printing apparatus 100 to produce a desired image (e.g., text, graphics, etc.) on the substrate 115. The print data may contain information such as substrate dimensions, image dimensions, image colors, etc.

The example image dimension analyzer 208 determines the dimensions of the image from the print data. According to the illustrated example, the image dimensions are identified in the print data. Alternatively, the image dimension analyzer 208 may analyze the print data to determine the image dimensions (e.g., by determining the width and/or height of the image to be printed).

The example substrate dimension analyzer 210 determines the dimensions of a substrate on which the image will be printed (e.g., the substrate 115 from FIG. 1). The example substrate dimension analyzer 210 determines the substrate dimensions by requesting dimension information from the printing apparatus 100 (e.g., from the controller 120 of the printing apparatus 100, from a firmware of the printing apparatus 100, etc.). Alternatively, the substrate dimension analyzer 210 may determine the dimensions of the substrate 115 by analyzing data from the print analyzer 206 (e.g., by analyzing the print data) or from any other source.

The nozzle identifier 212 of the illustrated example identifies a subset of nozzles (e.g., a subset of the nozzles 142 from FIG. 1) that are within a print area. Additionally or alternatively, the nozzle identifier 212 may identify a subset of the nozzles that are outside a print area. According to the illustrated example, nozzles are inside the print area when they will be utilized for printing an image (e.g., an image received from the image source 110). Alternatively, nozzles may be identified as being in the print area when they are located within an area in which printing will occur. For example, in a page wide array printer, nozzles may be inside the print area when the nozzles are located along a printbar within the width of the substrate (e.g., the substrate will pass below the nozzles during printing).

The example nozzle identifier 212 determines the print area by analyzing both the example image dimension analyzer 208 and the example substrate dimension analyzer 210 to determine the largest dimension and, thereby, the nozzles that are within the print area. Alternatively, the nozzle identifier 212 may utilize information from one of the image dimension analyzer 208 and the substrate dimension analyzer 210.

The example valve actuator 214 receives the identified nozzles from the nozzle identifier 212 and accordingly actuates the valves associated with the nozzles that are within the print area (e.g., the valves 144 that are associated with identified ones of the nozzles 142 of FIG. 1). Actuating the valves within the print area may include actuating a valve from the closed position to the open position, leaving an open valve in the open position, etc. Actuating the valves outside the print area may include actuating a valve from the open to the closed position, leaving a closed valve in the closed position, etc.

In some examples, the valve actuator 214 may be associated with a group of the nozzles 142 of FIG. 1. Thus, for example, the valve actuator 213 and one of the valves 144 may be associated with a group of nozzles 142 of FIG. 1. If, for example, a particular one of the nozzles 142 within such a group is within the print area, the example valve actuator 214 associated with that group of nozzles will be activated (or continue to be activated). If, for example, all of the nozzles 142 within the group are determined to not be within the print area, then the example valve actuator 214 associated with that group of nozzles will be deactivated (or remain deactivated). Alternatively, any other approach to grouping and activating/deactivating the valve actuator 214 may be utilized.

Thus, the example valve controller 205 controls valves associated with nozzles of the printhead(s) (e.g., a printhead (s) on a printbar of a wide array printer) to substantially prevent ink evaporation from nozzles that are outside the print area.

Figure 3:
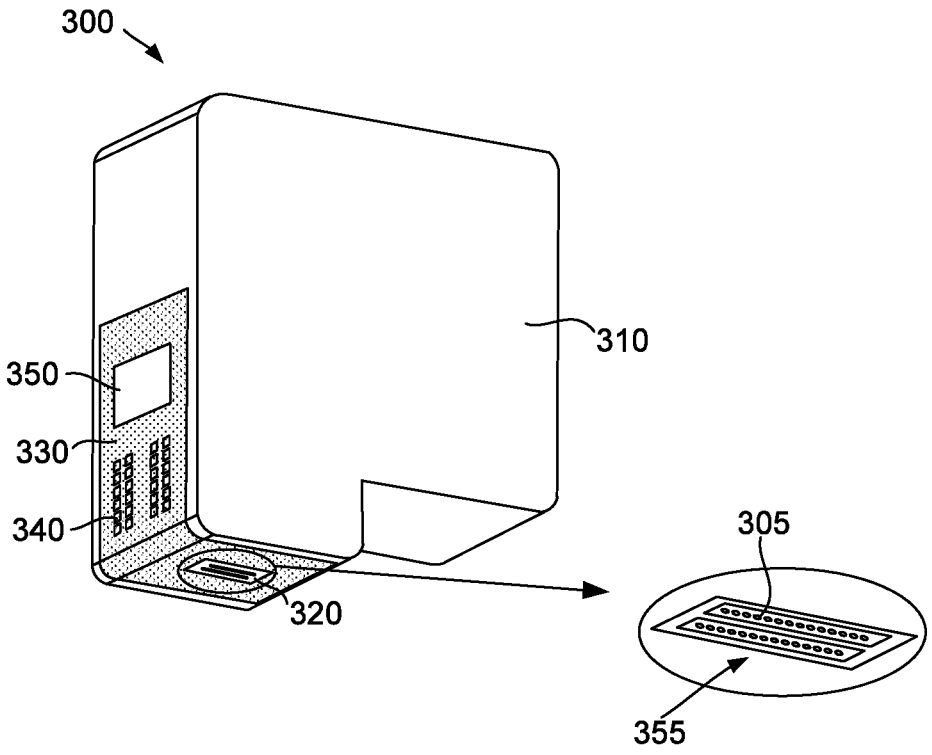
FIG. 3 illustrates an example printing cartridge for use with a printing apparatus that can be used to implement the examples disclosed herein.

FIG. 3 is a block diagram of an example printing cartridge 300 that can be used to implement the example printing apparatus 100 of FIG. 1. In this example, the printing cartridge 300 includes nozzles 305, an example fluid reservoir 310, an example die 320, an example flexible cable 330, example conductive pads 340 and an example memory chip 350. The example flexible cable 330 is coupled to the sides of the cartridge 300 and includes traces that couple the example memory 350, the example die 320 and the example conductive pads 340.

The nozzles 305 of the cartridge 300 of the illustrated example include valves 355 that are controllable between an open position and a closed position. In some examples, a first subset of nozzles 305 may eject a first color of ink while a second subset of nozzles 305 may eject a second color of ink. Thus, if the image being printed uses the first subset of nozzles 305, the valves 355 of the second subset of nozzles 305 may be positioned in the closed position to substantially prevent ink in the unused nozzles 305 from evaporating. However, the cartridge 300 may have any number of nozzle groupings that are associated with any number of colors (e.g., 1, 3, 4, etc.) and/or other logical grouping of the nozzles 305. Alternatively, the nozzles 305 may not be grouped.

In operation, the example cartridge 300 may be installed in a carriage cradle of, for example, the example printer 105 of FIG. 1. When the example cartridge 300 is installed within the carriage cradle, the example conductive pads 340 are pressed against corresponding electrical contacts in the cradle to enable the printer 105 to communicate with and/or control the electrical functions of the cartridge 300. For example, the example conductive pads 340 enable the printer 105 to access and/or write to the example memory chip 350.

The memory chip 350 of the illustrated example may include a variety of information such as the type of fluid cartridge, the kind of fluid contained in the cartridge, an estimate of the amount of fluid remaining in the fluid reservoir 310, calibration data, error information and/or other data. In some examples, the memory chip 350 includes information about when the cartridge 300 should receive maintenance. In some examples, the printer 105 can take appropriate action based on the information contained in the memory chip 350, such as notifying the user that the fluid supply is low or altering printing routines to maintain image quality.

To print an image on the substrate 115, the example printer 105 moves the cradle carriage containing the cartridge 300 over the substrate 115. To cause an image to be printed on the substrate 115, the example printer 105 sends electrical signals to the cartridge 300 via the electrical contacts in the carriage cradle. The electrical signals pass through the conductive pads 340 of the cartridge 300 and are routed through the flexible cable 330 to the die 320. The example die 320 then ejects a small droplet of fluid from the reservoir 310 onto the surface of the substrate 115. Droplets of ink combine to form an image on the surface of the substrate 115.

Figure 4:
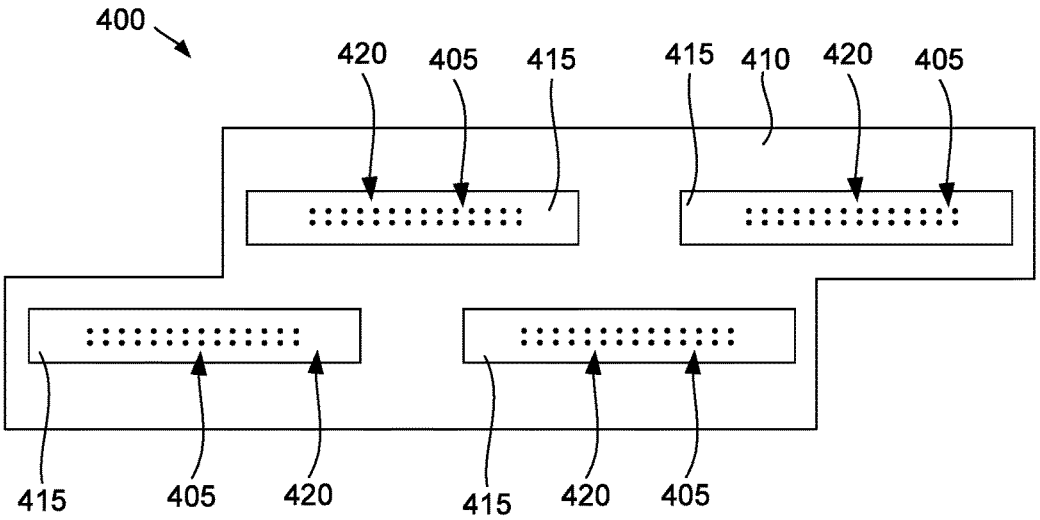
FIG. 4 illustrates an example wide inkjet array for use with a printing apparatus that can used to implement the examples disclosed herein.

FIG. 4 is a diagram of a printbar 400 (e.g., a printbar of a wide inkjet array (e.g., page wide inkjet array)) that can be used to implement the example printing apparatus 100 of FIG. 1. The example printbar 400 includes a plurality of nozzles 405, a carrier 410 and a plurality of dies 415. The individual nozzles 405 and/or the dies 415 may be communicatively coupled to the controller 120 such that each nozzle is selectively activatable to eject fluid onto the substrate 115. For example, the substrate 115 may be moved past the printbar 400 and the nozzles 405 may be controlled to eject ink onto the substrate 115 to print an image on the substrate 115.

The example nozzles 405 include an associated valve 420 (e.g., a valve that can be opened or closed to control fluid flow for a nozzle). The example valves 420 are controllable and/or actuatable between an open position and a closed position. To substantially prevent ink within unused ones of the example nozzles 405 from evaporating, when imaging the substrate 115, a first subset of the nozzles 405 being used to image the substrate 115 may be in an open position while a second subset of the nozzles 405 not being used to image the substrate may be in a closed position. The first and second subsets may be selected based on the image being printed, the print area, the dimensions of the substrate 115, etc.

Figure 6:
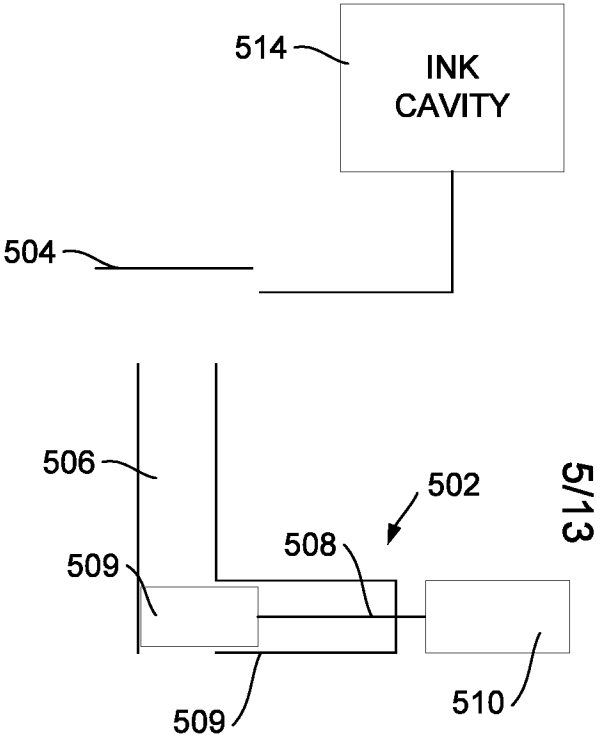
FIG. 6 illustrates the example nozzle of FIG. 5 showing the example valve in a closed position.
Figure 5:
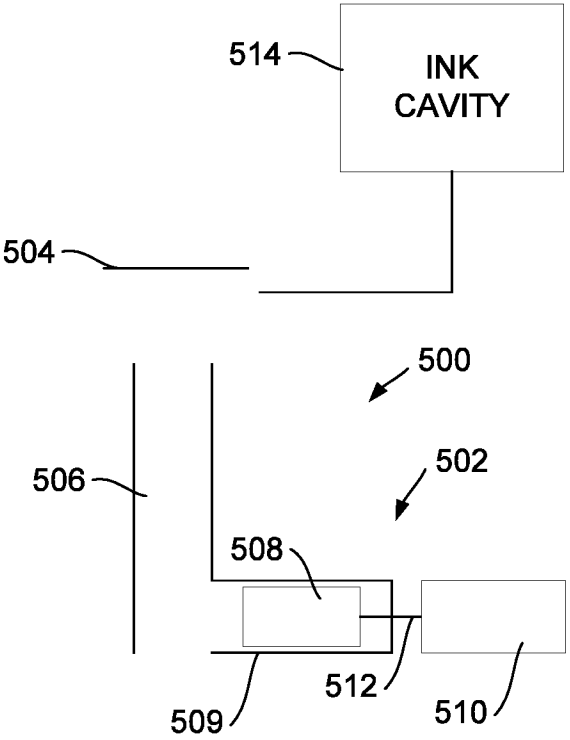
FIG. 5 illustrates an example nozzle including an example valve in an open position that can be used to implement the examples disclosed herein.

FIGS. 5 and 6 show an example nozzle 500 including an example valve (e.g., a sliding valve) 502 that together can be used to implement the example nozzles 142, 305, 405, the valves 144, 355, 420 and, generally, the examples disclosed herein. The example nozzle 500 includes a resistor 504 and an aperture 506. The example valve 502 includes an example flow control member 508 positioned within a transverse bore 509. The flow control member 508 of the illustrated example is a piston. Alternatively, the flow control member 508 may be plug, gate, etc. In this example, the flow control member 508 is coupled to an actuator 510 by an example stem 512. Alternatively, the flow control member 508 may be directly coupled to the actuator 510. The actuator 510 may be any suitable actuator such as a micro solenoid actuator, a piezoelectric linear actuator, a nanoactuator, a piezo actuator, a piezo stack actuator, a chip miniature piezo actuator, a preloaded nano-precision piezo translator, etc.

In operation, ink obtained from an example ink cavity 514 for the example nozzle 500 is heated by the example resistor 504 (e.g., a resistive heater) to form a bubble of ink. As the ink bubbles, it is pushed out of the example nozzle 500 to form an image on the substrate 115.

In another example, a piezoelectric actuator may be utilized to eject ink whereby selective deformation of the piezoelectric actuator causes droplets of ink to be ejected. In such an example, the heater is not used to vaporize the ink, but the heater is still used to heat the ink a smaller amount to lower the viscosity of the ink. The methods and apparatus disclosed herein are not limited to a particular type of printer. On the contrary, the disclosed methods and apparatus may be utilized to selectively activate and/or deactivate heaters associated with any type of printing implement that is outside a print area.

FIG. 5 shows the example valve 502 in an open position enabling fluid flow through the example aperture 506 and/or ambient air flow within the nozzle 500.

FIG. 6 shows the example valve 502 in a closed position substantially preventing fluid flow through the aperture 506 and/or ambient air to flow within the nozzle 500. While FIG. 5 shows the valve 502 fully open and FIG. 6 shows the valve 502 fully closed, the actuator 510 may position the flow control member 508 in a position between the fully open position and the fully closed position to suit a particular application (e.g., 20% open, 23% open, 50% open, etc.).

Figure 8:
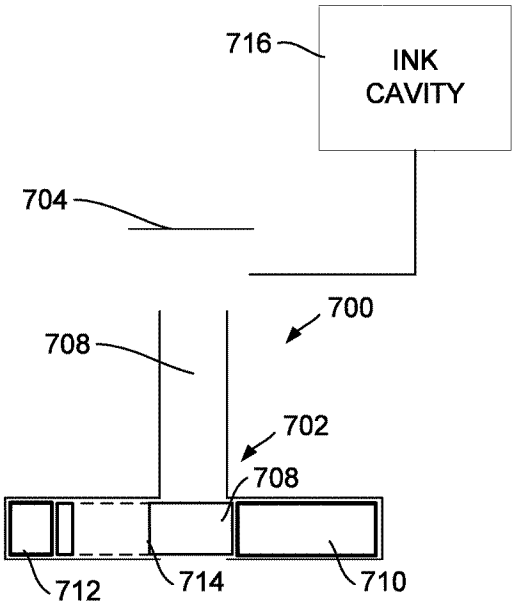
FIG. 8 illustrates the example nozzle of FIG. 7 showing the example valve in a closed position.
Figure 7:
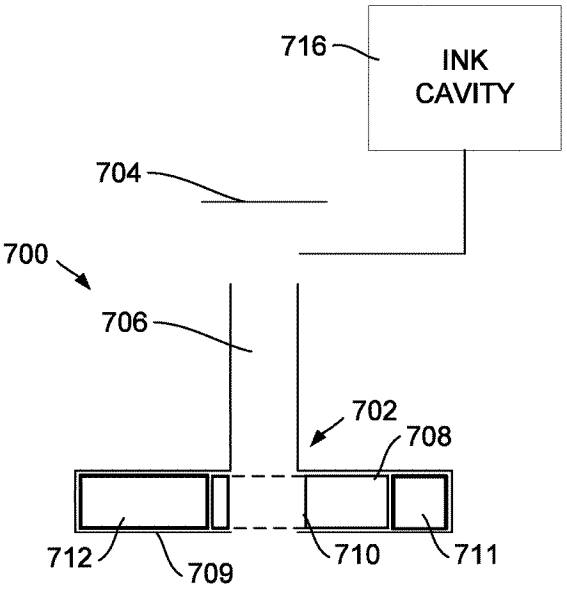
FIG. 7 illustrates an example nozzle including an example valve in an open position that can be used to implement the examples disclosed herein.
Figure 9:
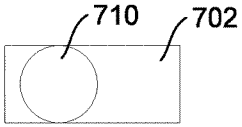
FIG. 9 illustrates an example fluid control member of the valve of FIGS. 7 and 8.

FIGS. 7 and 8 show an example nozzle 700 including an example valve 702 that can be used to implement the nozzles 142, 305, 405, the valves 144, 305, 420 and, generally, the examples disclosed herein. The example nozzle 700 includes a resistor 704 and an aperture 706. The example valve 702 includes a flow control member 708 positioned in a transverse bore 709. The flow control member 708 of the illustrated example is a gate defining an aperture 710. Alternatively, the flow control member 708 may be a plug, a slider, etc. In this example, the flow control member 708 is moved by first and second actuators 711, 712 to align and/or offset the aperture 710 of the flow control member 708 with the aperture 706 of the nozzle 700. The apertures 706, 710 are aligned when the valve 702 is in the open position and the apertures 706, 710 are offset when the valve 702 is in the closed position. The actuators 711, 712 may be any suitable actuator such as a nanoactuator, a piezo actuator, a piezo stack actuator, a chip miniature piezo actuator, a preloaded nano-precision piezo translator, etc. FIG. 9 shows a detailed view of the flow control member 708 and the aperture 710 defined therethough.

In operation, ink obtained from an ink cavity 716 for the example nozzle 700 is heated by the resistor 704 to form the bubble of ink. As the ink bubbles, it is pushed out of the nozzle 700 to form an image on the substrate 115. In another example, deformation of a piezoelectric actuator is used to eject droplets of ink. FIG. 7 shows the second actuator 712 being actuated to align the apertures 706, 710 and, thus, position the valve 702 in the open position. FIG. 8 shows the first actuator 710 being actuated to offset the aperture 706, 710 and, thus, position the valve 702 in the closed position.

While FIG. 7 shows the valve 702 fully open and FIG. 8 shows the valve 702 fully closed, the actuator 711, 712 may position the flow control member 708 in a position between the fully open position and the fully closed position to suit a particular application (e.g., 20% open, 23% open, 50% open, etc.).

Figure 10:
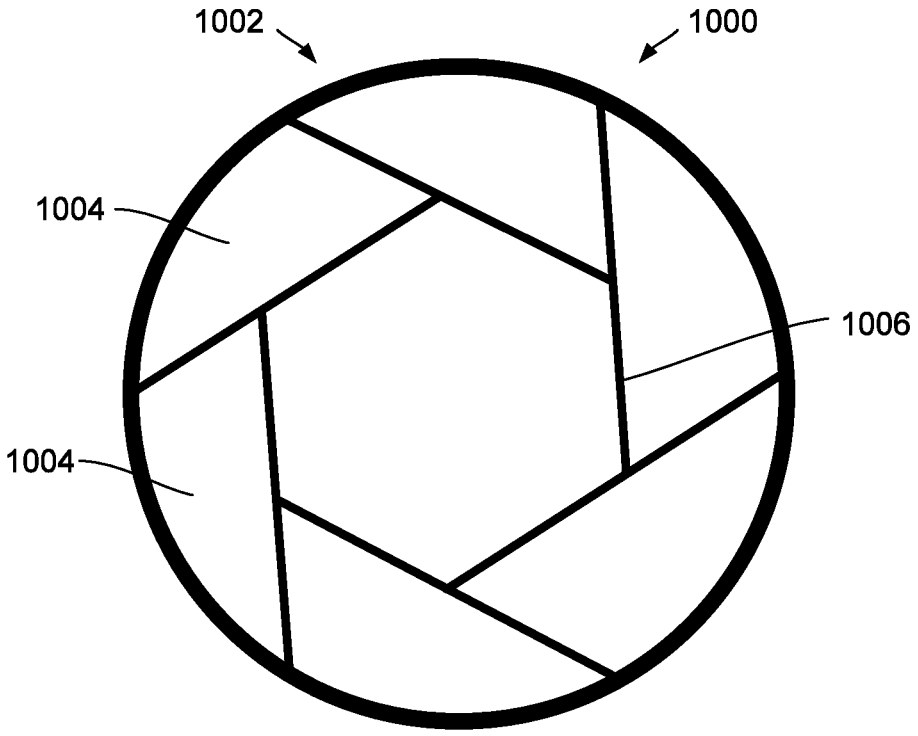
FIG. 10 illustrates an example nozzle including an example valve in an open position that can be used to implement the examples disclosed herein.
Figure 11:
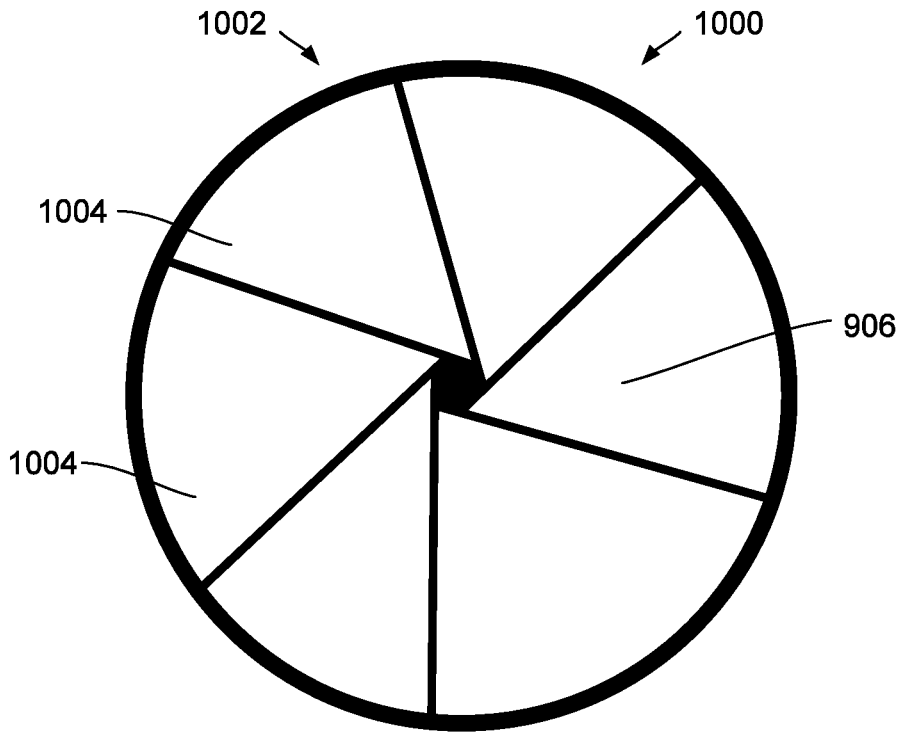
FIG. 11 illustrates the example nozzle of FIG. 10 showing the example valve in a closed position.

FIGS. 10 and 11 show an example nozzle 1000 and an example valve 1002 (e.g., a shutter valve) that can be used to implement the nozzles 142, 305, 405, the valves 144, 355, 420 and, generally, the examples disclosed herein. The example valve 1002 includes a plurality of panes 1004 that are movable between an open position shown in FIG. 10 and a closed position shown in FIG. 11 to control fluid flow through an aperture 1006 of the example nozzle 1000. While FIG. 10 shows the valve 1002 fully open and FIG. 11 shows the valve 1002 fully closed, the valve 1002 may be positioned between the fully open position and the fully closed position to suit a particular application (e.g., 20% open, 23% open, 50% open, etc.).

Figure 12:
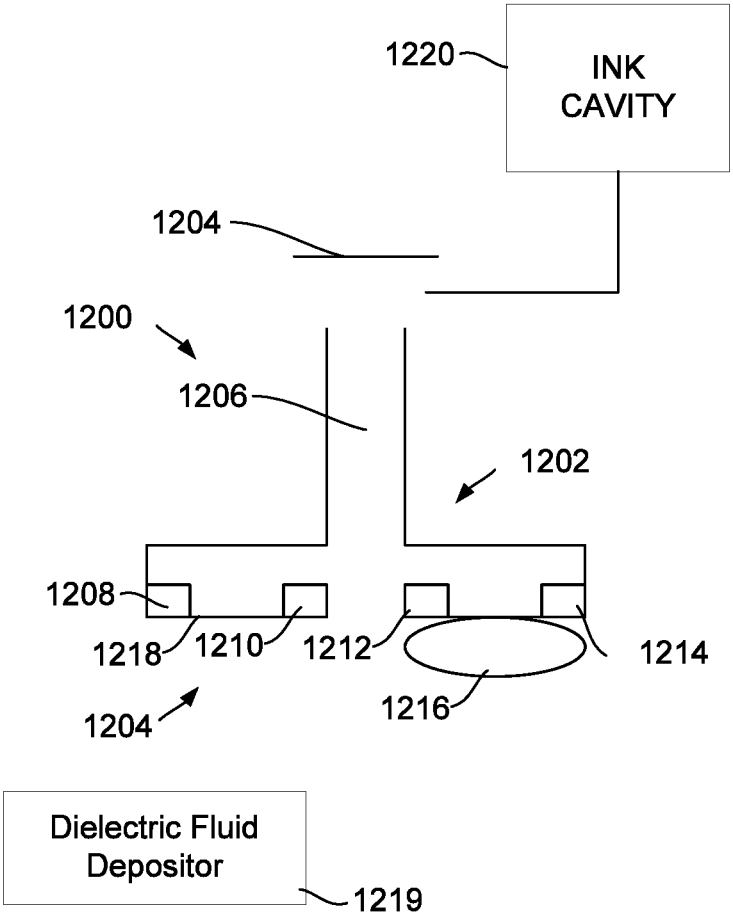
FIG. 12 illustrates an example nozzle including an example valve in an open position that can be used to implement the examples disclosed herein.
Figure 13:
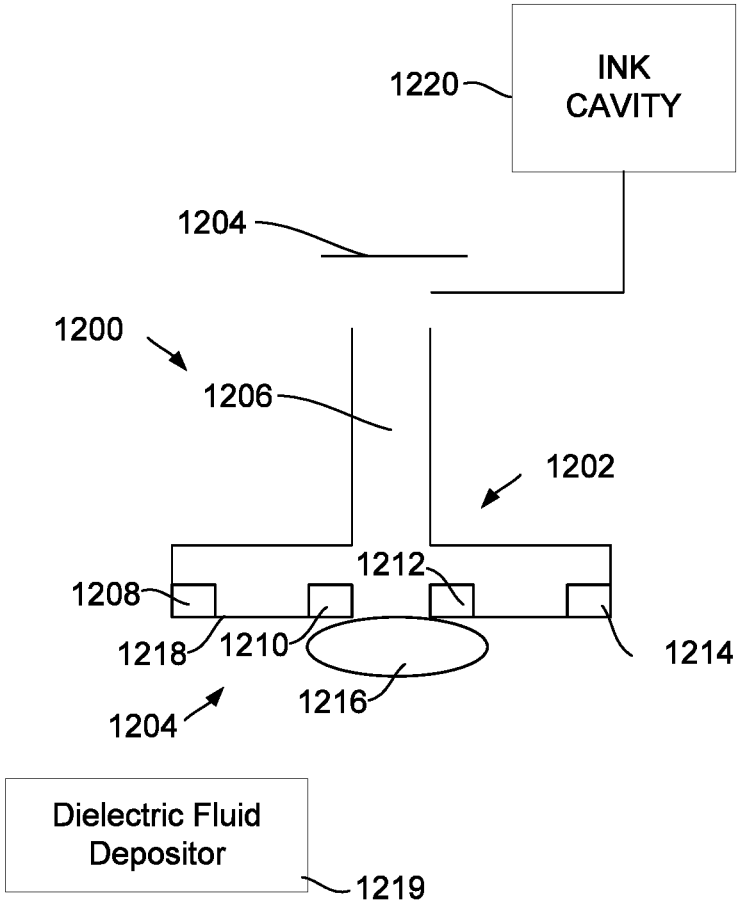
FIG. 13 illustrates the example nozzle of FIG. 12 showing the example valve in a closed position.

FIGS. 12 and 13 show an example nozzle 1200 including an example valve 1202 that can be used to implement the nozzles 142, 305, the valves 144, 255, 320 and, generally, the examples disclosed herein. The example nozzle 1200 includes a resistor 1204 and an aperture 1206. The example valve 1202 includes first and second electrodes 1208, 1210 positioned on a first side of the aperture 1206 and third and fourth electrodes 1212, 1214 positioned on a second side of the aperture 1206. In this example, the electrode(s) 1208, 1210, 1212, 1214 are energizable to control the position of an example dielectric fluid 1216 disposed on a plate or surface 1218 of the nozzle 1200 relative to the aperture 1206 to selectively allow and/or prevent fluid flow (e.g., air) into the nozzle. The dielectric fluid 118 may be deposited on the surface 1218 using a depositor 119 after, for example, a particular event occurs. In some examples, the depositor 119 includes an arm having a wiper that is moved across the surface 1218 to deposit the dielectric fluid 1216 on the surface 1218. In some examples, the event is associated with the dielectric fluid 1216 not being present on the surface 1218, maintenance being performed on the nozzle 1200, a particular length of time lapsing, etc. In other examples, the dielectric fluid 1216 is deposited on the surface 1218 by an operator using an applicator (e.g., a rag, a sponge, an eye dropper, etc.) including the dielectric fluid 1216.

In operation, ink obtained from an example ink cavity 1220 for the example nozzle 1200 is heated by the example resistor 1204 to form a bubble of ink. As the ink bubbles, it is pushed out of the example nozzle 1200 to form an image on the substrate 115 (FIG. 1). In another example, deformation of a piezoelectric actuator is used to eject droplets of ink. FIG. 12 shows the state of the dielectric fluid 1216 when the third and fourth electrodes 1212 and 1214 are energized to position the dielectric fluid 1216 away from the aperture 1206 and open the valve 1202.

FIG. 13 shows the state of the dielectric fluid 1216 when the second and third electrodes 1210, 1212 are energized to position the dielectric fluid 1216 over the aperture 1206 and close the valve 1202.

While an example manner of implementing the printing apparatus 100 of FIG. 1 is illustrated in FIGS. 1-13, one or more of the elements, processes and/or devices illustrated in FIGS. 1-13 may be combined, divided, re-arranged, omitted, eliminated and/or implemented in any other way. Further, the example controller 120, the example processor 145, the example valve controller 147, the example data storage device 150, and/or, more generally, the printing apparatus 100 of FIG. 1 and the example print analyzer 206, the example dimension analyzer, the example substrate dimension analyzer 210, the example nozzle identifier 212, the example valve actuator and, more generally, the example valve controller 205 may be implemented by hardware, software, firmware and/or any combination of hardware, software and/or firmware. Thus, for example, any of the example controller 120, the example processor 145, the example valve controller 147, the example data storage device 150, and/or, more generally, the example printing apparatus 100 and the example print analyzer 206, the example dimension analyzer, the example substrate dimension analyzer 210, the example nozzle identifier 212, the example valve actuator and, more generally, the example valve controller 205 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, controller 120, the example processor 145, the example valve controller 147, the example data storage device 150, the example print analyzer 206, the example dimension analyzer, the example substrate dimension analyzer 210, the example nozzle identifier 212 and the example valve actuator is/are hereby expressly defined to include a tangible computer readable storage device or storage disk such as a memory, a digital versatile disk (DVD), a compact disk (CD), a Blu-ray disk, etc. storing the software and/or firmware. Further still, the example printing apparatus 100 of FIG. 1 may include one or more elements, processes and/or devices in addition to, or instead of, those illustrated in FIGS. 1-13, and/or may include more than one of any or all of the illustrated elements, processes and devices.

Figure 14:
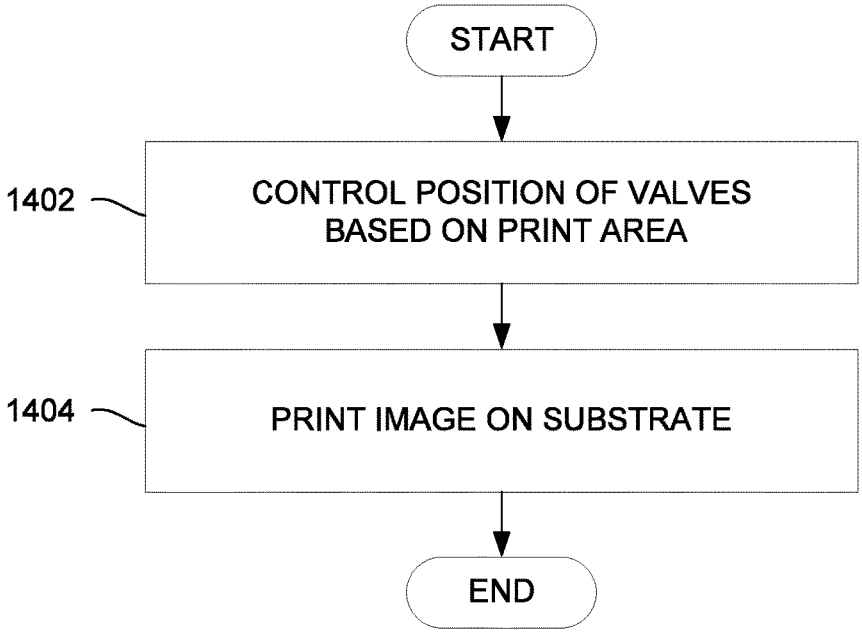
FIGS. 14 and 15 are flowcharts representative of machine readable instructions that may be executed to control fluid flow through a printhead in the printing apparatus of FIG. 1.
Figure 15:
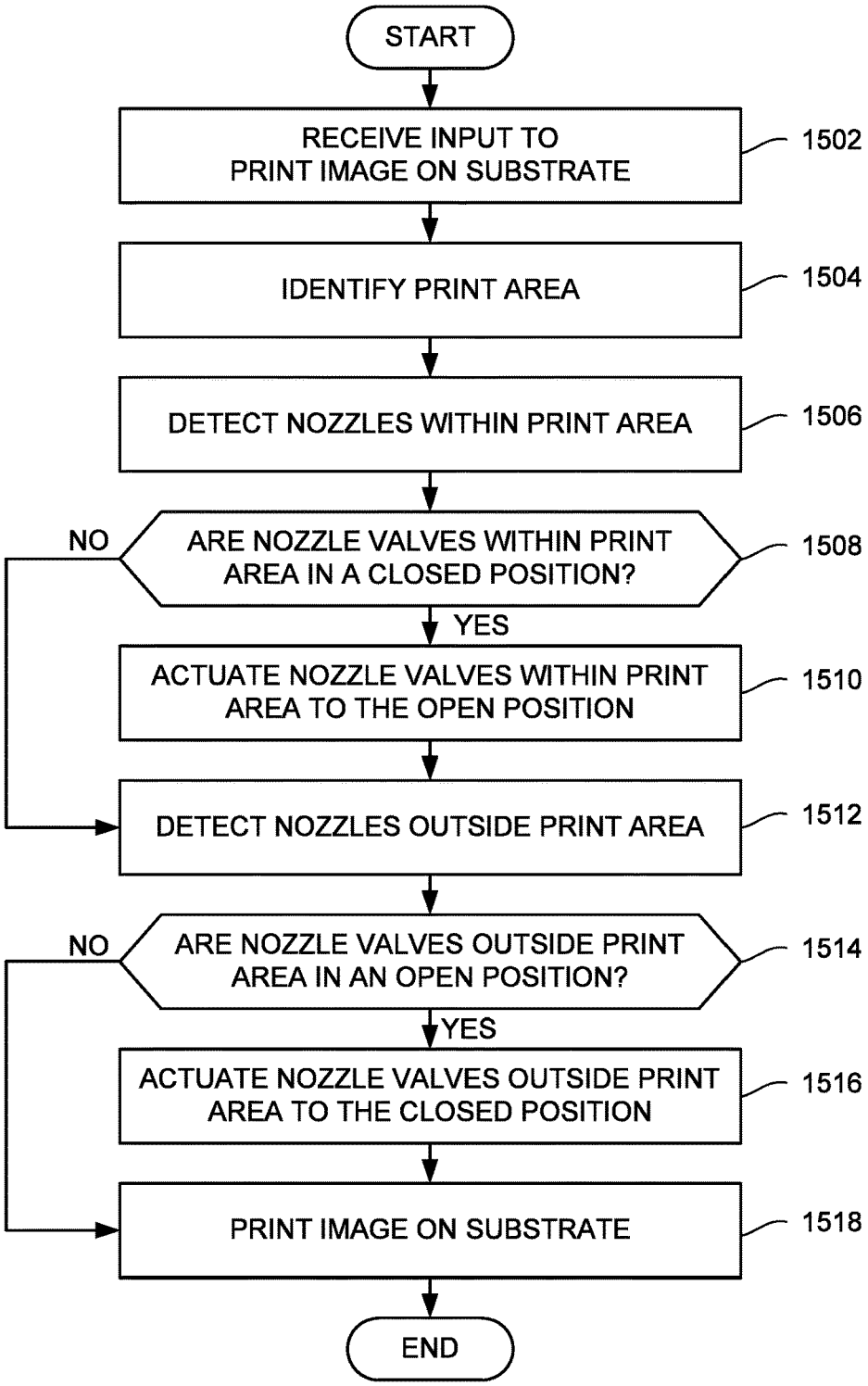

Flowcharts representative of example machine readable instructions for implementing the printing apparatus 100 are shown in FIGS. 14 and 15. In the examples, the machine readable instructions comprise programs for execution by a processor such as the processor 1612 shown in the example processor platform 1600 discussed below in connection with FIG. 16. The programs may be embodied in software stored on a tangible computer readable storage medium such as a CD-ROM, a floppy disk, a hard drive, a digital versatile disk (DVD), a Blu-ray disk, or a memory associated with the processor 1612, but the programs and/or parts thereof could alternatively be executed by a device other than the processor 1612 and/or embodied in firmware or dedicated hardware. Further, although the example programs are described with reference to the flowcharts illustrated in FIGS. 14 and 15, many other methods of implementing the example printing apparatus 100 may alternatively be used. For example, the order of execution of the blocks may be changed, and/or some of the blocks described may be changed, eliminated, or combined.

As mentioned above, the example processes of FIGS. 14 and 15 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 14 and 15 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The process of FIG. 14 begins by the example valve actuator 214 of FIG. 2 controlling the example valves 142 based on a print area determined by the example image dimension analyzer 208 and/or the example substrate dimension analyzer 210 (block 1402). The valves 142 may be implemented by any of the valves 355, 420, 502, 702, 1002, 1202 disclosed herein. In some examples, the print area is associated with a width and/or size of the substrate 115 on which an image is to be printed and/or is being printed as determined by the example substrate dimension analyzer 210. In some examples, the print area is associated with a width and/or size of image to be printed and/or being printed on the substrate 115 as determined by the example image dimension analyzer 208. Regardless of how the print area is determined, the valve actuator 214 controls the valves 144 of the nozzles 142 identified by the nozzle identifier 212 to open the ones of the valves 144 being used to print on the substrate 115. The valve actuator 214 controls the valves 144 of the nozzles 142 to close the ones of the valves 144 not being used print on the substrate. Closing the example valves 144 of the unused nozzles 142 reduces evaporation and drying of ink of the unused nozzles 142.

At block 1404, the example controller 120 causes an image to be printed on the substrate 115 by actuating the printhead motion mechanics 125 and/or the substrate motion mechanics 130 and/or by causing the printhead 140 to eject fluid through the respective nozzles 142. In examples in which the printer 105 is a page wide array printer, the printer 105 may not include the printhead motion mechanics 125.

The process of FIG. 15 begins when the processor 145 receives input to print an image on the example substrate 115 of FIG. 1 (block 1502). The input may be an input received by the printing apparatus 100 directly from a user, and/or may be received from a computer external to the printing apparatus 100, etc. At block 1504, a print area is identified (block 1502). In some examples, the print area is identified by the valve controller 147 implemented by the valve controller 205 of FIG. 2 based on the input received. Additionally or alternatively, the print area may be identified by a computer external to the printing apparatus 100. For example, the print area may be identified when the example print analyzer 206 receives information about a requested print job and the example image dimension analyzer 208 determines the dimensions of the image to be printed and/or the example substrate dimension analyzer 210 determines the dimensions of the substrate 115. Additionally or alternatively, the print area may be identified by a computer external to the printing apparatus 100. The print area may be associated with the width of the substrate, the width of the image, the size of the substrate, the size of the image, etc.

The example nozzle identifier 212 detects the ones of the nozzles 142 that are within the print area (block 1506). In some examples, the nozzles 142 within the print area are identified by the nozzle identifier 212 based on the received input. Additionally or alternatively, the print area may be identified by a computer external to the printing apparatus 100. At block 1508, the example valve actuator 214 determines if the example valves 144 of the ones of the nozzles 142 within the determined print area are in the closed position (block 1508). If the valve(s) 144 within the determined print area are closed, the valve actuator 214 causes the closed valves 144 to open (block 1510).

The example nozzle identifier 212 then detects one of the nozzles 142 outside the print area (block 1512). In some examples, the ones of the nozzles 142 outside the print area are identified by the nozzle identifier 212 based on the received input. At block 1514, the example valve actuator 214 determines if the valves 144 of the ones of the nozzles 142 outside the determined print area are in the open position (block 1514). If the valve(s) 144 within the determined print area are open, the example valve actuator 214 causes the open valves 144 to close (block 1518).

At block 1518, the processor 145 causes an image to be printed on the substrate 115 by actuating the printhead motion mechanics 125 and/or the substrate motion mechanics 130 and/or by causing the example printhead 140 to eject fluid through the ones of nozzles 142 in the print area (block 1418). In examples in which the printer 105 is a page wide array printer, the printer 105 may not include the printhead motion mechanics 125.

Figure 16:
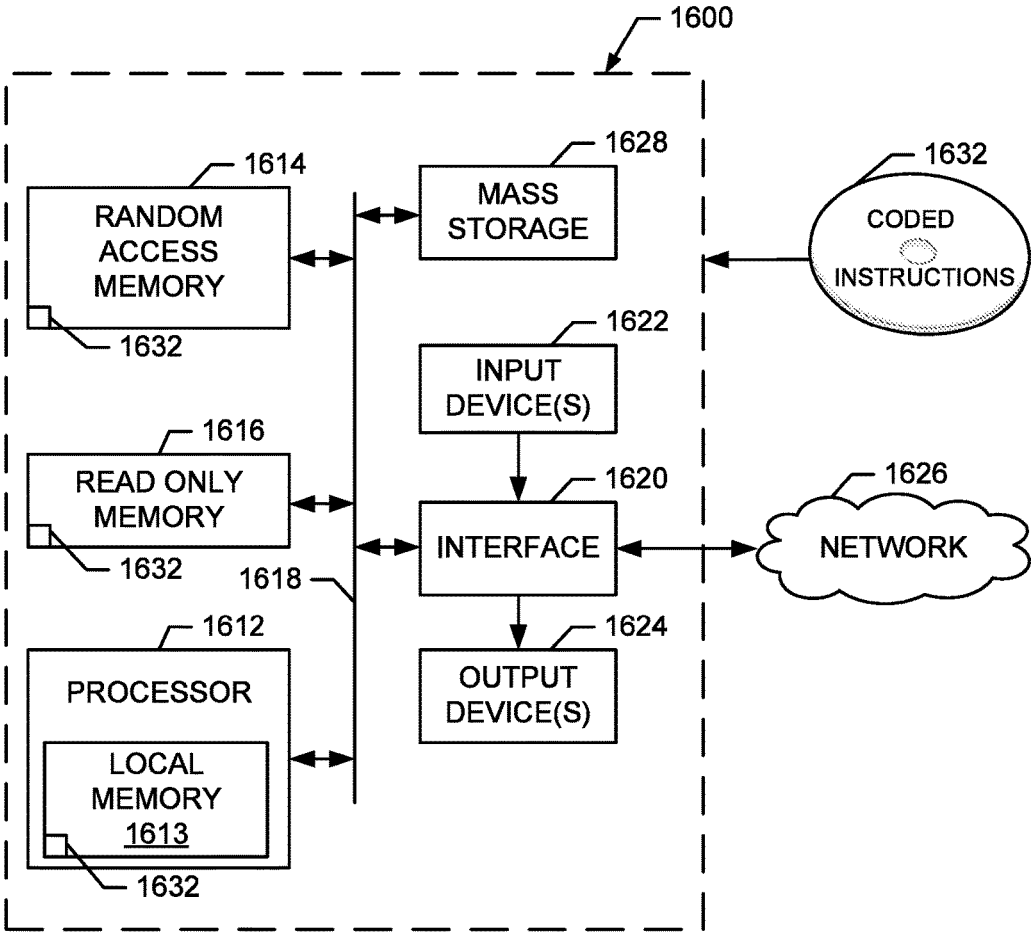
FIG. 16 is a processor platform to execute the instructions of FIGS. 14 and 15 to implement the printing apparatus of FIG. 1.

FIG. 16 is a block diagram of an example processor platform 1600 capable of executing the instructions of FIGS. 14 and 15 to implement the printing apparatus 100 of FIGS. 1-13. The processor platform 1600 can be, for example, a server, a personal computer, a mobile device (e.g., a cell phone, a smart phone, a tablet such as an iPad™), a personal digital assistant (PDA), an Internet appliance, or any other type of computing device.

The processor platform 1600 of the illustrated example includes a processor 1612. The processor 1612 of the illustrated example is hardware. For example, the processor 1612 can be implemented by one or more integrated circuits, logic circuits, microprocessors or controllers from any desired family or manufacturer.

The processor 1612 of the illustrated example includes a local memory 1613 (e.g., a cache). The processor 1612 of the illustrated example is in communication with a main memory including a volatile memory 1614 and a non-volatile memory 1616 via a bus 1618. The volatile memory 1614 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1616 may be implemented by flash memory and/or any other desired type of memory device. Access to the main memory 1614, 1616 is controlled by a memory controller.

The processor platform 1600 of the illustrated example also includes an interface circuit 1620. The interface circuit 1620 may be implemented by any type of interface standard, such as an Ethernet interface, a universal serial bus (USB), and/or a PCI express interface.

In the illustrated example, one or more input devices 1622 are connected to the interface circuit 1620. The input device(s) 1622 permit(s) a user to enter data and commands into the processor 1612. The input device(s) can be implemented by, for example, an audio sensor, a microphone, a keyboard, a button, a mouse, a touchscreen, a track-pad, a trackball, isopoint and/or a voice recognition system.

One or more output devices 1624 are also connected to the interface circuit 1620 of the illustrated example. The output devices 1624 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED) and/or speakers). The interface circuit 1620 of the illustrated example, thus, typically includes a graphics driver card, a graphics driver chip or a graphics driver processor.

The interface circuit 1620 of the illustrated example also includes a communication device such as a transmitter, a receiver, a transceiver, a modem and/or network interface card to facilitate exchange of data with external machines (e.g., computing devices of any kind) via a network 1626 (e.g., an Ethernet connection, a digital subscriber line (DSL), a telephone line, coaxial cable, a cellular telephone system, etc.).

The processor platform 1600 of the illustrated example also includes one or more mass storage devices 1628 for storing software and/or data. Examples of such mass storage devices 1628 include floppy disk drives, hard drive disks, compact disk drives, Blu-ray disk drives, RAID systems, and digital versatile disk (DVD) drives.

The coded instructions 1632 of FIGS. FIGS. 14 and 15 may be stored in the mass storage device 1628, in the volatile memory 1614, in the non-volatile memory 1616, and/or on a removable tangible computer readable storage medium such as a CD or DVD.

From the foregoing, it will appreciated that the above disclosed methods, apparatus and articles of manufacture selectively control nozzle valves of a printhead and/or printbar to substantially prevent ink within non-used nozzles from evaporating. Using the examples disclosed herein, the useful life of these nozzles is extended. In some examples, these nozzle valves may be controlled between an open position and a closed position prior to a print job being initiated and/or during a print job based on a size of a substrate being imaged and/or based on a size of the image to be printed on a substrate. In some examples, the nozzle valves may be controlled between an open position and a closed position while the printing apparatus is continuously operating based on the size of the substrate being imaged and/or based on the size of the image to be produced on the substrate. While inkjet printing is described in the foregoing examples, the methods and apparatus disclosed herein may be implemented on any other type of printer that includes nozzles or on other devices that include nozzles. For example, the methods and apparatus disclosed herein can be implemented on three-dimensional printing devices.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A fluid ejection device comprising:

a fluid ejection orifice;

a fluid actuator actuatable between an active state in which the fluid actuator applies pressure to fluid to eject the fluid through the fluid ejection orifice and an inactive state in which the fluid actuator does not apply pressure to the fluid such that the fluid is not being pushed by the fluid actuator through the fluid ejection orifice; and a valve to selectively close the fluid ejection orifice concurrently with the fluid actuator being in the inactive state.

2. The fluid ejection device of claim 1 further comprising a print bar, the print bar comprising:

a first print die comprising the fluid ejection orifice, the fluid actuator and the valve; and a second print die comprising:

a second fluid ejection orifice;

a second fluid actuator actuatable between an active state in which the fluid actuator applies pressure to the fluid to eject the fluid through the second fluid ejection orifice and an inactive state in which the fluid is not being pushed by the second fluid actuator through the second fluid ejection orifice; and a second valve to selectively close the second fluid ejection orifice concurrently with the second fluid actuator being in the inactive state.

3. The fluid ejection device of claim 2, wherein the first print die and the second print die have overlapping lengths.

4. The fluid ejection device of claim 1, wherein the valve comprises a microfluidic shutter valve.

5. The fluid ejection device of claim 1, wherein the valve comprises:

a piston positioned within a bore transverse to the fluid ejection orifice; and an actuator to selectively move the piston between an open position and a closed position.

6. The fluid ejection device of claim 5, wherein the actuator comprises first and second piezoelectric actuators disposed within the bore, the piston disposed between the first and second piezoelectric actuators.

7. The fluid ejection device of claim 5, wherein, in the open position, an aperture of the piston is to be aligned with an aperture of the respective nozzle to enable fluid flow through the nozzle.

8. The fluid ejection device of claim 1, wherein the valve comprises electrodes adjacent a plate proximate the fluid ejection orifice, the electrodes to control a position of a dielectric fluid to be disposed on the plate between a covering position in which the dielectric fluid covers the fluid ejection orifice and a non-covering position in which the dielectric fluid is spaced from the fluid ejection orifice.

9. The fluid ejection device of claim 8, further comprising a depositor to deposit the dielectric fluid on the plate.

10. The fluid ejection device of claim 8, wherein the electrodes comprise first and second electrodes on a first side of the aperture and third and fourth electrodes on a second side of the aperture.

11. The fluid ejection device of claim 8, wherein a voltage is to be applied to second and third electrodes to position the dielectric fluid in the covering position.

12. The fluid ejection device of claim 8, wherein a voltage is to be applied to first and second electrodes or to the third and fourth electrodes to position the dielectric fluid in the non-covering position.

13. The fluid ejection device of claim 1 further comprising:

a second fluid ejection orifice;

a second fluid actuator actuatable between an active state in which the fluid actuator applies pressure to the fluid to eject the fluid through the second fluid ejection orifice and an inactive state in which the fluid is not being pushed by the second fluid actuator through the second fluid ejection orifice; and a second valve to selectively close the second fluid ejection orifice concurrently with the second fluid actuator being in the inactive state, wherein the second valve is positionable independent of positioning of the valve.

14. The fluid ejection device of claim 1, wherein the fluid ejection orifice and the fluid actuator form one of a plurality of first nozzles in a first row, the fluid ejection device comprising:

second nozzles in a second row parallel to the first row, each of the second nozzles comprising:

a second fluid ejection orifice;

a second fluid actuator actuatable between an active state in which the fluid actuator applies pressure to the fluid to eject the fluid through the second fluid ejection orifice and an inactive state in which the fluid is not being pushed by the second fluid actuator through the second fluid ejection orifice; and a second valve to selectively close the second fluid ejection orifice concurrently with the second fluid actuator being in the inactive state.

15. The fluid ejection device of claim 1, wherein the fluid actuator comprises a thermal resistor.

16. A method comprising:

controlling the ejection of fluid from a nozzle by selectively actuating a fluid actuator that displaces and ejects fluid through an ejection orifice of the nozzle; and at least partially closing the ejection orifice of the nozzle, while the fluid actuator is inactive, to reduce evaporation of the fluid.

17. A fluid ejection bar comprising:

fluid ejection dies, each of the fluid ejection dies comprising:

rows of nozzles, each of the nozzles having its own different individual associated fluid actuator and ejection orifice, each fluid actuator to apply pressure to fluid to eject fluid through the associated ejection orifice; and a selectively controllable valve for each of the nozzles to selectively close the ejection orifice to reduce air flow into the nozzle through the ejection orifice.

18. The fluid ejection bar of claim 17, wherein the fluid actuator is selected from a group of fluid actuators consisting of a thermal resistor and a piezoelectric actuator.

19. The fluid ejection bar of claim 17 further comprising a processor to:

actuate a first fluid actuator of a first one of the nozzles to apply pressure to fluid to eject fluid from the first one of the nozzles;

while the first fluid actuator is ejecting fluid from the first one of the nozzles, maintaining a second fluid actuator of a second one of the nozzles in an inactive state so as to not eject fluid from the second one of the nozzles; and while the second fluid actuator is being maintained in the inactive state, positioning the valve of the second one of the nozzles to reduce outside air flow into the fluid ejection orifice of the second one of the nozzles.

20. The fluid ejection bar of claim 17, wherein each of the nozzles has its own different associated selectively controllable valve to selectively close the associated ejection orifice.

* * * * *